US010879630B2

(12) United States Patent
Mastel

(10) Patent No.: US 10,879,630 B2
(45) Date of Patent: Dec. 29, 2020

(54) CONDUCTOR CONNECTION TERMINAL

(71) Applicant: WAGO VERWALTUNGSGESELLSCHAFT MBH, Minden (DE)

(72) Inventor: Rudolf Mastel, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 16/542,982

(22) Filed: Aug. 16, 2019

(65) Prior Publication Data

US 2019/0386407 A1 Dec. 19, 2019

Related U.S. Application Data

(63) Continuation of application No. PCT/EP2018/053581, filed on Feb. 13, 2018.

(30) Foreign Application Priority Data

Feb. 21, 2017 (DE) ..... 10 2017 103 508

(51) Int. Cl.
*H01R 4/48* (2006.01)

(52) U.S. Cl.
CPC ..... *H01R 4/4836* (2013.01); *H01R 4/4845* (2013.01)

(58) Field of Classification Search
CPC ..... H01R 4/4836; H01R 4/4845
See application file for complete search history.

(56) References Cited

U.S. PATENT DOCUMENTS

D826,168 S * 8/2018 Mastel ..... D13/147
10,193,245 B2 * 1/2019 Lorenschat ..... H01R 43/18
(Continued)

FOREIGN PATENT DOCUMENTS

CN 105449382 A 3/2016
DE 102007050936 B4 7/2009
(Continued)

OTHER PUBLICATIONS

International Search Report dated May 14, 2018 in corresponding application PCT/EP2018/053581.
(Continued)

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A conductor connection terminal, having an insulating-material housing, a spring-force clamping connection point, which is disposed in the insulating-material housing and which has a clamping spring, and comprising a pivotably mounted actuating lever for actuating the clamping spring, wherein the actuating lever is movable from a closed position to an open position and vice versa, wherein the actuating lever has a driver element for deflecting a clamping leg of the clamping spring in order to open a clamping point of the conductor connection terminal, which clamping point is formed with the clamping leg, wherein the conductor connection terminal has at least one spring-holding element, which is not disposed on the actuating lever, for holding the clamping leg in the open position, such that the actuating lever is not loaded with the restoring force of the clamping spring when the clamping point is open.

12 Claims, 7 Drawing Sheets

(56) References Cited

U.S. PATENT DOCUMENTS

| | | | | |
|---|---|---|---|---|
| 2018/0076536 | A1* | 3/2018 | Hartmann | H01R 4/4845 |
| 2018/0205159 | A1* | 7/2018 | Lorenschat | H01R 4/4845 |
| 2019/0109390 | A1* | 4/2019 | Lorenschat | H01R 43/20 |

FOREIGN PATENT DOCUMENTS

| | | | | |
|---|---|---|---|---|
| DE | 102011110640 | A1 | 2/2013 | |
| DE | 102012005465 | B3 | 5/2013 | |
| DE | 102014114026 | A1 * | 3/2016 | H01R 4/4836 |
| DE | 102014114026 | A1 | 3/2016 | |
| EP | 1213791 | A1 | 6/2002 | |

OTHER PUBLICATIONS

International Preliminary Report on Patentability dated Aug. 27, 2019 in corresponding application PCT/EP2018/053581.

* cited by examiner

CONDUCTOR CONNECTION TERMINAL

This nonprovisional application is a continuation of International Application No. PCT/EP2018/053581, which was filed on Feb. 13, 2018, and which claims priority to German Patent Application No. 10 2017 103 508.7, which was filed in Germany on Feb. 21, 2017, and which are both herein incorporated by reference.

BACKGROUND OF THE INVENTION

Field of the Invention

The present invention relates to a conductor connection terminal, comprising an insulating-material housing, a spring-force clamping connection point, which is disposed in the insulating-material housing and which has a clamping spring, and comprising a pivotably mounted actuating lever for actuating the clamping spring, wherein the actuating lever is movable from a closed position to an open position and vice versa, wherein the actuating lever has a driver element for deflecting a clamping leg of the clamping spring in order to open a clamping point of the conductor connection terminal, which clamping point is formed with the clamping leg.

Description of the Background Art

In a conductor connection terminal, a clamping leg can thus be deflected by the actuating lever against the restoring force of the clamping spring and the clamping point is opened when the actuating lever is moved to the open position. When the actuating lever is moved from the open position to the closed position, however, the clamping spring supports the movement of the actuating lever, at least within a certain pivoting region. Depending on the design of the conductor connection terminal, in this pivoting region the actuating lever can snap back largely alone in the direction of the closed position. However, this can be associated with drawbacks in the handling of the conductor connection terminal, in particular in conductor connection terminals for large conductor cross sections, which have correspondingly robustly sized clamping springs.

A generic conductor connection terminal is known from DE 10 2007 050 936 B4. It is proposed there that the actuating lever is slowed down when snapping back.

SUMMARY OF THE INVENTION

It is therefore an object of the present invention to provide a conductor connection terminal, which allows easy operation of the actuating lever without much effort.

In an exemplary embodiment, a conductor connection terminal is provided in that the conductor connection terminal has at least one spring-holding element, which is not disposed on the actuating lever, for holding the clamping leg in the open position, such that the actuating lever is not loaded with the restoring force of the clamping spring when the clamping point is open, wherein the conductor connection terminal has at least one spring-releasing element disposed on the actuating lever, which spring-releasing element can be coupled to the spring-holding element during at least one segment of a restoring motion of the actuating lever from the open position to the closed position, whereby the at least one spring-holding element is mechanically actuated by the at least one spring-releasing element in order to release the clamping leg held on the at least one spring-holding element. The clamping leg held on the at least one spring-holding element can thus be released by a restoring motion of the actuating lever from the open position to the closed position by mechanical actuation and deflection of the at least one spring-holding element by the at least one spring-releasing element.

The invention allows the desired convenient operation of the actuating lever, in particular while avoiding the snapping back of the lever during the restoring motion, by a decoupling of the clamping leg from the actuating lever when it has been moved to the open position and then the clamping point is opened. When the open position of the actuating lever is reached or shortly before this, according to the invention, the clamping leg hitherto taken along via the driver element on the actuating lever and accordingly deflected against the restoring force of the clamping spring or an actuating leg, connected therewith, is fixed to a spring-holding element, e.g., by snapping, clamping, or another type of holding of the clamping leg on the spring-holding element. Because the spring-holding element is not disposed on the actuating lever itself, it is freed from the restoring force of the clamping spring as soon as the clamping leg is held on the spring-holding element. Accordingly, the actuating lever can then be moved substantially without force back in the direction of the closed position.

A spring-releasing element can be provided on the actuating lever, which element is configured to release the clamping leg held on the at least one spring-holding element by mechanical actuation of the at least one spring-holding element by the spring-releasing element. This occurs in a restoring motion of the actuating lever from the open position to the closed position, such that the conductor connection terminal can be actuated in the usual manner when opening and closing; i.e., only the one actuating lever needs to be operated and not a separate release member for releasing the clamping leg held on the spring-holding element.

The pivotably mounted actuating lever can be pivotably mounted on or in the insulating-material housing or on another part of the conductor connection terminal.

In an open position of the actuating lever, the clamping point can thus be opened, so that an electrical conductor can be removed from the clamping point. In the closed position of the actuating lever, the clamping point can be closed, so that an electrical conductor is fixedly clamped at the clamping point. As mentioned, the clamping point is formed with the clamping leg of the clamping spring, i.e., with the participation of the clamping leg, e.g., of a clamping edge of the clamping leg. The clamping point can be formed further with a further metal component of the conductor connection terminal, the component forming a counter surface for the clamping leg. The further metal component can be, e.g., a busbar or a part of a contact frame or a metallic housing part, or a part of the clamping spring itself.

The spring-holding element can be disposed in the pivoting region or in the deflection region of the clamping leg. The spring-holding element can also be disposed in the pivoting region of the spring-releasing element. The mechanical actuation and deflection of the at least one spring-holding element by the at least one spring-releasing element can take place directly, i.e., by direct contact between the spring-holding element and the spring-releasing element, or indirectly, e.g., via a lever or ram acting between the spring-holding element and the spring-releasing element.

Depending on the design of the clamping spring, the driver element of the actuating lever can engage it at one of multiple different points in order to deflect the clamping leg.

The driver element can engage, for example, directly on the clamping leg itself, or on an actuating leg connected to the clamping leg. To hold the clamping leg in the open position, for example, the clamping leg itself can be fixed to the spring-holding element, e.g., be hooked into it. Alternatively, the actuating leg can be fixed to the spring-holding element.

It is also provided that, as a result of a restoring motion of the actuating lever from the open position to the closed position, the at least one spring-holding element can be deflected transversely to the pivoting plane of the actuating lever by the at least one spring-releasing element. In this way, the spring-releasing element can be advantageously integrated into the mechanism of the conductor connection terminal. The at least one spring-releasing element can be deflected in this case by the spring-releasing element in particular in an orthogonal direction to the pivoting plane of the actuating lever.

The at least one spring-releasing element can be configured for the mechanical actuation of the at least one spring-holding element for releasing the clamping leg in the region of at least the last 30% of the pivoting movement of the actuating lever from the open position to the closed position. In this way, a snapping back of the clamping leg takes place only at the end of the pivoting movement of the actuating lever from the open position to the closed position. The actuation of the at least one spring-holding element can take place in particular in the region of the last 20% of the pivoting movement or in the region of the last 10% of the pivoting movement of the actuating lever.

The at least one spring-releasing element can be disposed laterally on the actuating lever. Accordingly, the at least one spring-releasing element is disposed laterally offset from a center plane of the actuating lever, which corresponds to the pivoting plane of the actuating lever. In this way, the actuating effort for deflecting the spring-holding element to release the clamping leg is relatively low.

The actuating lever can have a radial outer bearing region for mounting the actuating lever in the insulating-material housing, wherein this bearing region overlaps at least in sections with the at least one spring-holding element and is configured for the mechanical actuation of the at least one spring-holding element for releasing the clamping leg during a restoring motion of the actuating lever from the open position to the closed position. In this way, the spring-releasing element can be disposed in a structurally favorable manner on the actuating lever. The actuating lever can be mounted, e.g., in the insulating-material housing and/or on a retaining cage of the retaining bracket, which is used to fix the clamping spring and/or a busbar of the conductor connection terminal.

The bearing region of the actuating lever can have a varying thickness along its radial circumference in the transverse direction to the pivoting plane of the actuating lever, which forms the at least one spring-releasing element. In this way, the spring-holding element can be pushed to the side by the spring-releasing element to remove the fixation of the clamping leg. The clamping leg can then snap past the spring-holding element which is pushed to the side.

The spring-holding element can be formed, e.g., as a part or a region of the insulating-material housing of the conductor connection terminal.

The at least one spring-holding element can be formed as an elastically deflectable metal plate. In this way, a robust spring-holding element is realized, which also withstands prolonged and frequent use.

The at least one spring-holding element can be disposed on a retaining cage or retaining bracket which is used for fixing the clamping spring and/or a busbar of the conductor connection terminal. In this way, the spring-holding element need not be provided as a separate component but can be disposed, e.g., as a metal component on the retaining cage, e.g., by a metal plate integrally formed with the retaining cage or retaining bracket.

The retaining cage can be designed here as a circumferentially closed metal component, i.e., as a metal component that encloses a conductor mounting space of the conductor connection terminal on four sides (right, left, up, down). If a retaining bracket is present, it can be, e.g., U-shaped, and the at least one spring-holding element can be disposed on it.

The conductor connection terminal can have at least two spring-holding elements disposed on opposite sides of the actuating lever. In this way, the clamping leg can be symmetrically held in the open position and kept free of undesirable torsional forces. The at least two spring-holding elements can be formed, for example, symmetric to one another.

Further, in a restoring motion of the actuating lever from the open position to the closed position, the at least two spring-holding elements can be spread apart away from one another by the at least one spring-releasing element. The clamping leg can slide between the two spring-holding elements because of the spreading apart, when they are deflected suitably far enough by the actuating lever.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
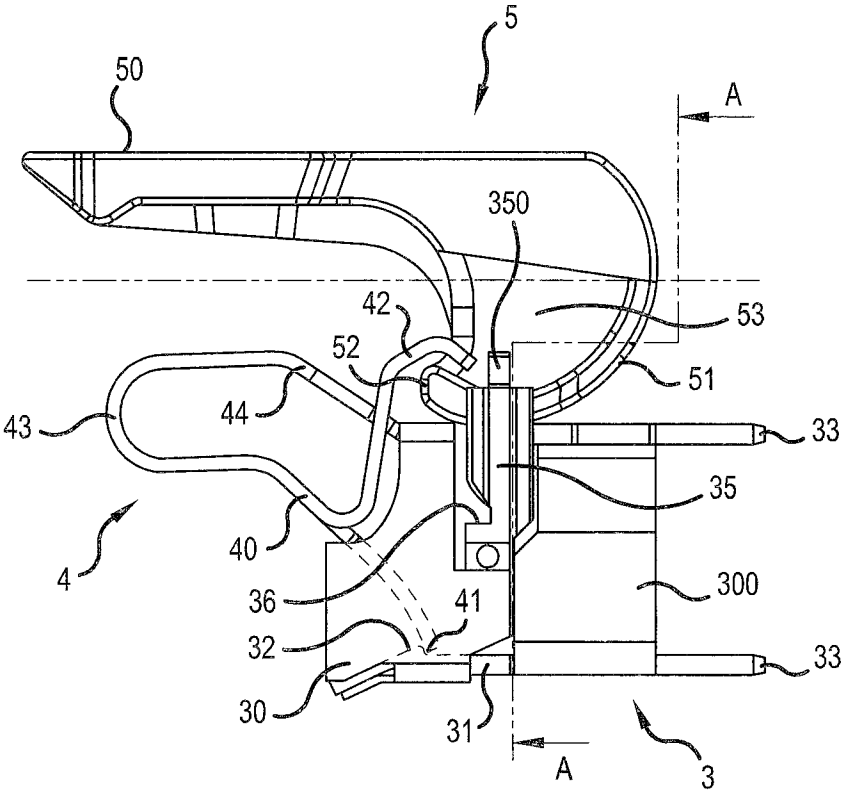
Figure 3:
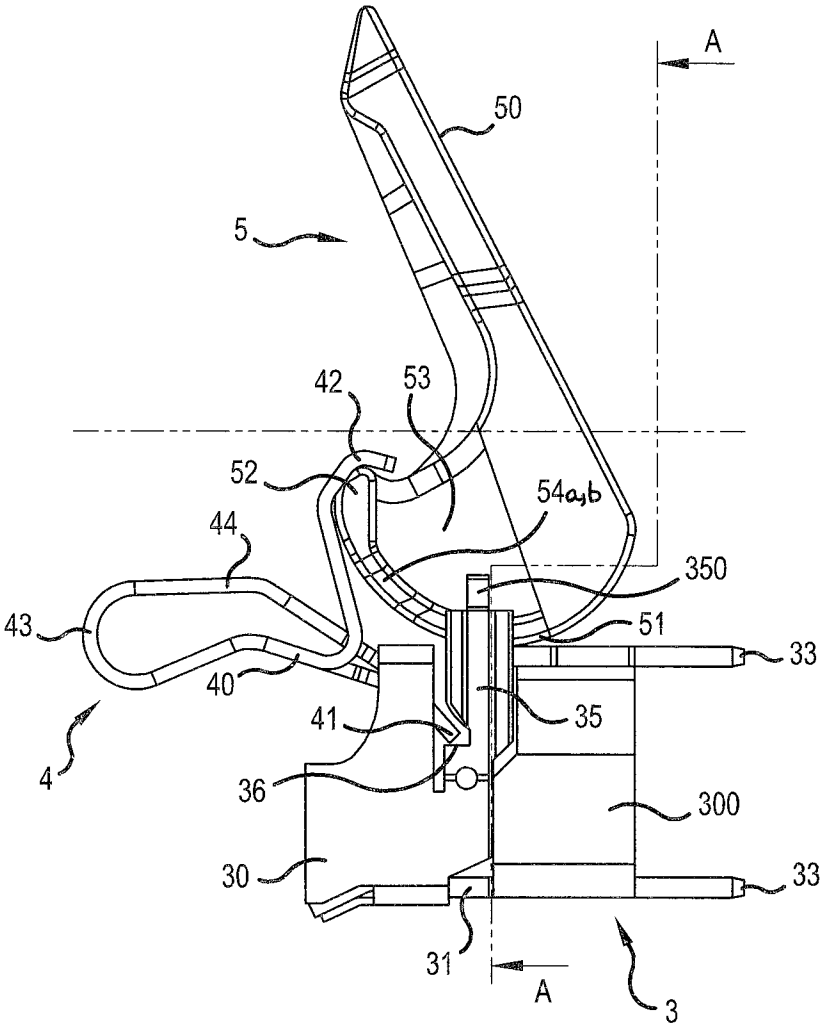
Figure 5:
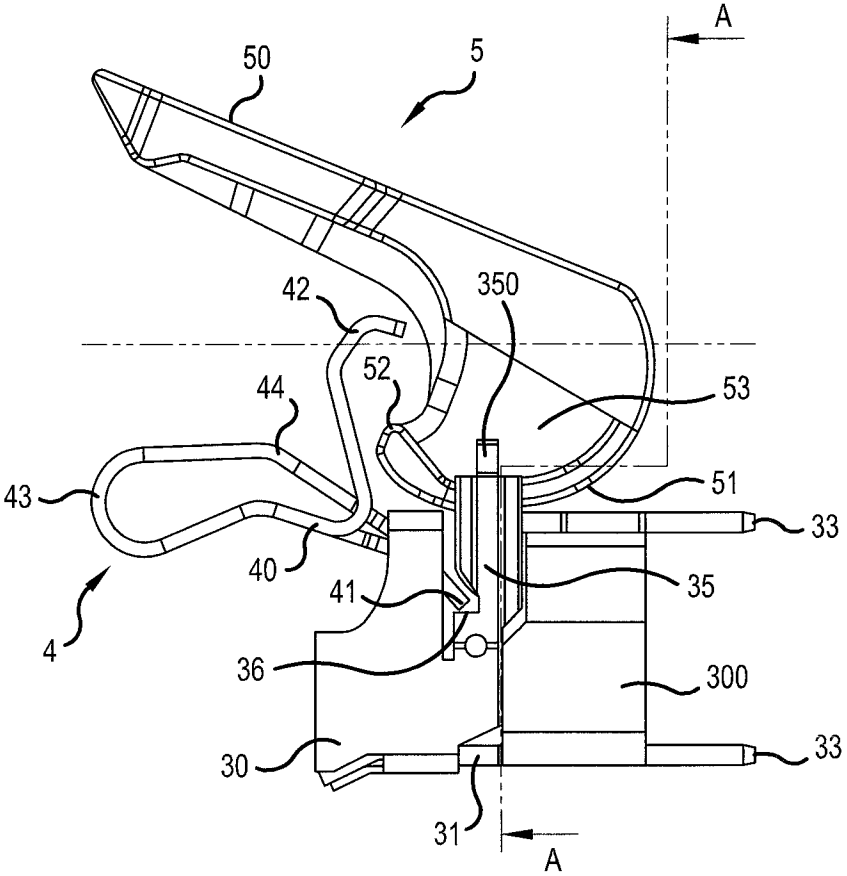

FIGS. 1, 3, and 5 each in a side view show the same contact insert with different positions of actuating lever 5.

Figure 2:
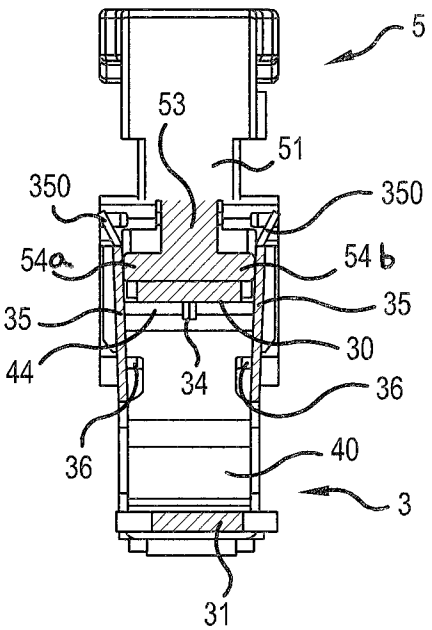
FIGS. 1 to 6 show a contact insert of a conductor connection terminal including an actuating lever in different views and positions of the actuating lever.
Figure 4:
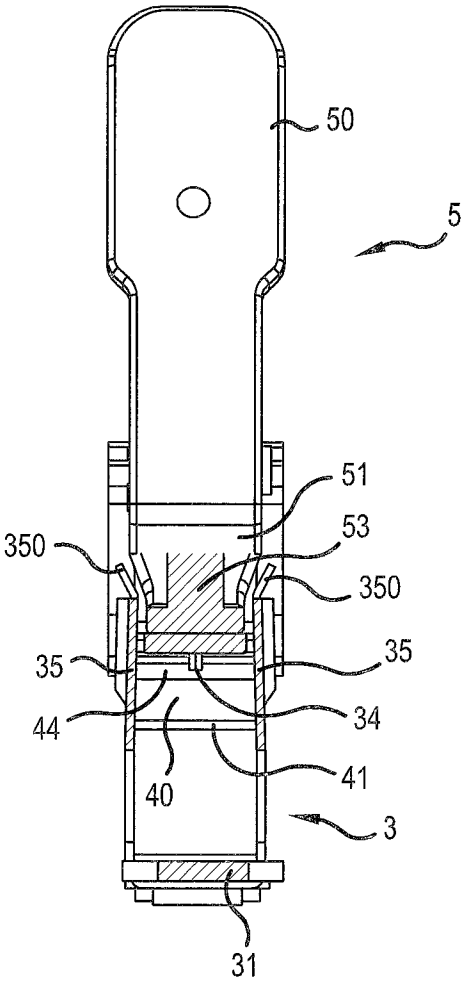
Figure 6:
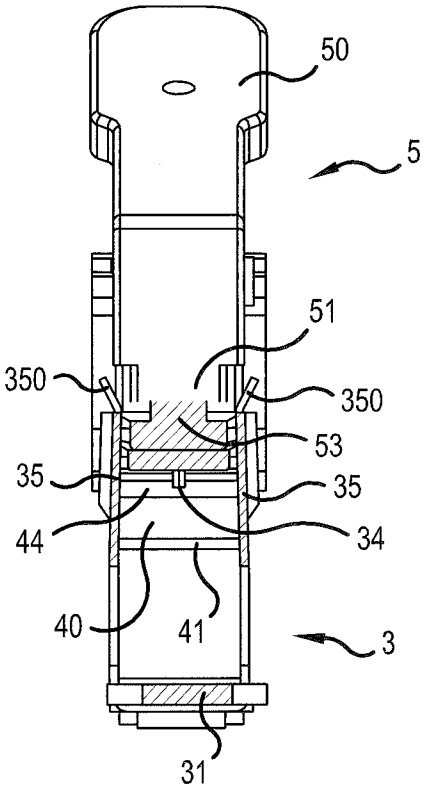

FIGS. 2, 4, and 6 show the contact insert of the respective preceding figure in the sectional plane A-A marked there; i.e., FIG. 2 shows the corresponding sectional plane from FIG. 1, FIG. 4 the corresponding sectional plane from FIG. 3, and FIG. 6 the corresponding sectional plane from FIG. 5.

In FIGS. 1 and 2, actuating lever 5 is in the closed position, in FIGS. 3 and 4 in the open position, and in FIGS. 5 and 6 in an intermediate position which can be assumed when the actuating lever is moved back from the open position to the closed position.

The contact insert has a metal component 3, a clamping spring 4, and the already mentioned actuating lever 5. Metal component 3 has a retaining cage 30 to which a busbar 31 is attached or is formed integrally therewith. Retaining cage 30 extends to the right towards a contact frame 300. Contact pins 33, which can be used for electrical contacting the contact insert with other components, e.g., a printed circuit board, protrude to the right from contact frame 300, i.e., toward the rear side of actuating lever 5. Retaining cage 30 also serves to hold clamping spring 4 via fixing projections 34 protruding into the interior of retaining cage 30. These fixing projections 34 can be punched out and bent out of the material of metal component 3.

It is possible to form retaining cage 30 integrally in the form of a metal component 3 together with contact frame 300. It is more advantageous, however, to form retaining cage 30 and contact frame 300 as separate components, because different requirements are placed on the spring elasticity of the electrical contacting. Contact frame 300 can be pushed, for example, onto busbar 31.

Clamping spring 4 has a clamping leg 40 and a contact leg 44. Clamping leg 40 is connected via a spring bend 43 to contact leg 44. Contact leg 44 has a fixing opening, via which it is hooked into fixing projections 34 in the interior of retaining cage 30.

Clamping leg 40 extends to a clamping edge 41 (shown by dashed lines in FIG. 1). If clamping spring 4 is in the position shown in FIG. 1, a clamping point formed between clamping edge 41 and a projection 32 of busbar 31 without an inserted electrical conductor is closed. An electrical conductor can be clamped between clamping edge 41 and projection 32. An actuating leg 42, which can be formed by a lateral section of the material of clamping leg 40, which is bent upward, i.e., bent pointing away from clamping edge 41, is further connected to clamping leg 40.

Actuating lever 5 has a manual actuating section 50, where actuating lever 5 can be operated by a user comfortably by hand, i.e., can be pivoted from the closed position shown in FIG. 1 to the open position shown in FIG. 3 or can be pivoted back accordingly. Actuating lever 5 has a radial outer bearing region 51, via which actuating lever 5 is supported on the upper side of retaining cage 30 and rolls thereon in a pivoting movement and/or executes a sliding movement. Actuating lever 5 further has a driver element 52 for deflecting clamping leg 40. Driver element 52 is disposed at a position at which it overlaps with actuating leg 42, so that upon movement of actuating lever 5 to the open position, this actuating leg 42 is engaged behind by driver element 52 and is deflected upward, as FIG. 3 shows. Because clamping leg 40 is connected to actuating leg 42, it participates in this deflection movement. Accordingly, the clamping point formed between clamping edge 41 and projection 32 is then opened. In this state, an electrical conductor can be conveniently inserted into retaining cage 30 or an electrical conductor already present therein can be removed.

On metal component 3, respective spring-holding elements 35 in the form of flexible metal plates are formed to the left and right of actuating lever 5. Spring-holding elements 35 are bent inward in the unloaded state, i.e., bent toward one another. Spring-holding elements 35 each have a supporting edge 36, on which clamping edge 41 of clamping leg 40 can be hooked and fixed thereto when actuating lever 5 has been moved into the open position (FIG. 3). If clamping edge 41 is hooked behind holding edges 36, actuating lever 5 can also be pivoted back in a certain angle range in the direction of the closed position without clamping leg 40 following this movement (FIGS. 5, 6). In particular, FIG. 5 shows this clearly by the distance between driver element 52 and actuating leg 42.

Laterally projecting spring-releasing elements 54*a* and 54*b*, which are clearly visible in FIG. 2, are integrally formed in a narrow central region 53 on actuating lever 5 (forming first spring-releasing element 54*a* and second spring-releasing element 54*b*). These are not visible in the sectional views of FIGS. 4 and 6 due to the pivoting position of actuating lever 5. It can be seen on the basis of a comparison, for example, of FIG. 4 with FIG. 2, that when actuating lever 5 reaches a certain pivoting position close to the closed position, spring releasing elements 54*a* and 54*b*, which are relatively broad in comparison with the narrow central region 53, abut laterally against spring-holding elements 35 and spread these apart. The spreading apart takes place so far that clamping leg 40 with clamping edge 41 can move between spring-holding elements 35, i.e., in the direction of a closed clamping point.

As FIG. 6 shows, actuating lever 5 is located there even before the release of the fixation of clamping leg 40 at holding edges 36 is reached. Actuating lever 5, which is not provided with the broad spring-releasing elements 54*a* and 54*b* in this area, therefore does not yet contact spring-holding elements 35 in this area. Only with a further pivoting of actuating lever 5 from the position shown in FIG. 5 in the direction of the closed position is the release of the fixation of clamping leg 40 by the spreading apart of spring-holding elements 35 triggered by spring-releasing elements 54*a* and 54*b*.

Figure 7:
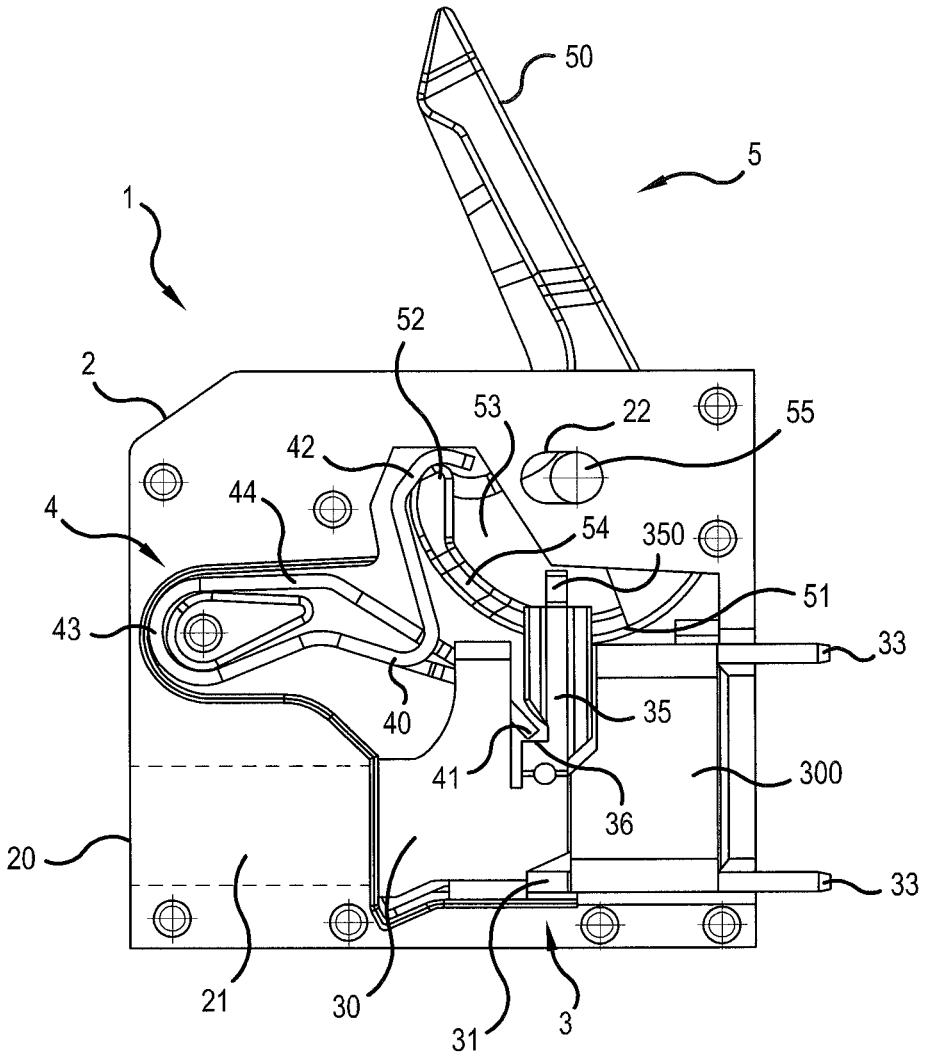
FIG. 7 shows a conductor connection terminal with a contact insert and an actuating lever according to FIGS. 1 to 6 in a side view.

FIG. 7 shows, by way of example, based on the open position of actuating lever 5, a conductor connection terminal 1 with the contact insert described above. Conductor connection terminal 1 has an insulating-material housing 2, which is shown partially open in the illustration of FIG. 7. Insulating-material housing 2 has a conductor insertion opening 20 to which a conductor insertion channel 21 connects. An electrical conductor inserted through conductor insertion opening 20 is guided through conductor insertion channel 21 toward retaining cage 30 and toward the clamping point between busbar 31 and clamping edge 41.

In contrast to the embodiment described with reference to FIGS. 1 to 6, actuating lever 5 in this case still has laterally projecting mounting axes 55, which are located in an elongated hole 22 of insulating-material housing 2. In this way, actuating lever 5 is mounted in insulating-material housing 2 and can also perform a certain linear movement relative to retaining cage 30 as a result of elongated hole 22, which movement occurs upon pivoting of actuating lever 5.

Figure 9:
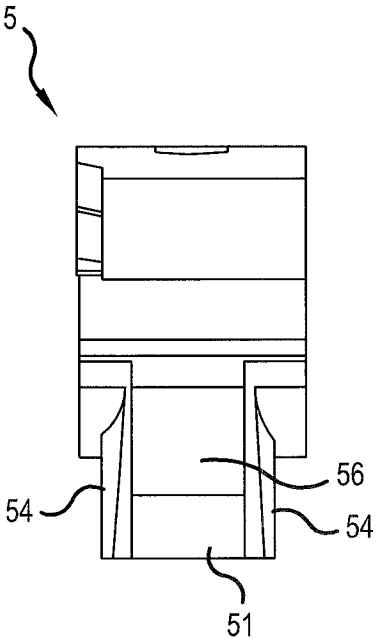
FIG. 9 shows the actuating lever according to FIG. 8 in a rear view.
Figure 8:
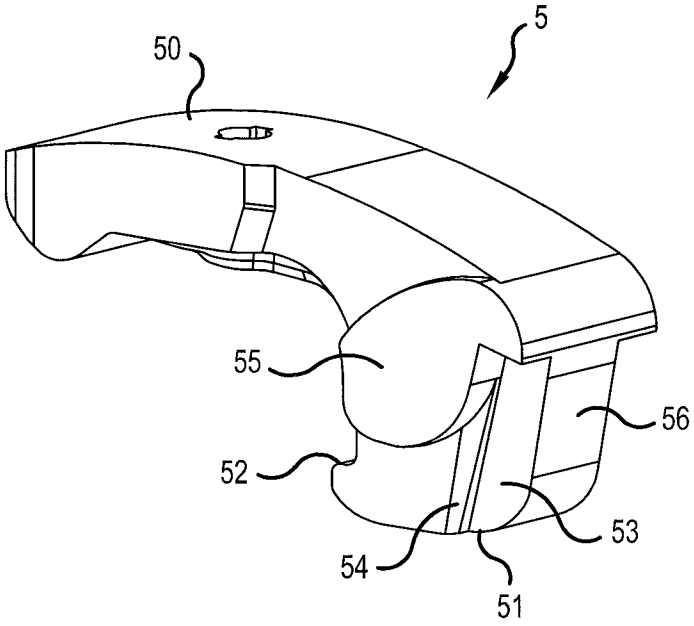
FIG. 8 shows a further embodiment of an actuating lever in a perspective view.

FIGS. 8 and 9 show an alternative embodiment of an actuating lever 5. It can be seen that mounting axis 55 in this case does not have a circular cross section, as in FIG. 7, but a shape advantageous for a floating mounting of actuating lever 5. Spring-releasing elements 54, formed as lateral widenings of a narrower central region 53, can again be seen. Actuating lever 5 further has a rear bearing surface 56, which is made substantially flat. In this way, in the open position actuating lever 5 can rest on the surface of retaining cage 30 or other suitable component and is thereby fixed in the open position.

Figure 10:
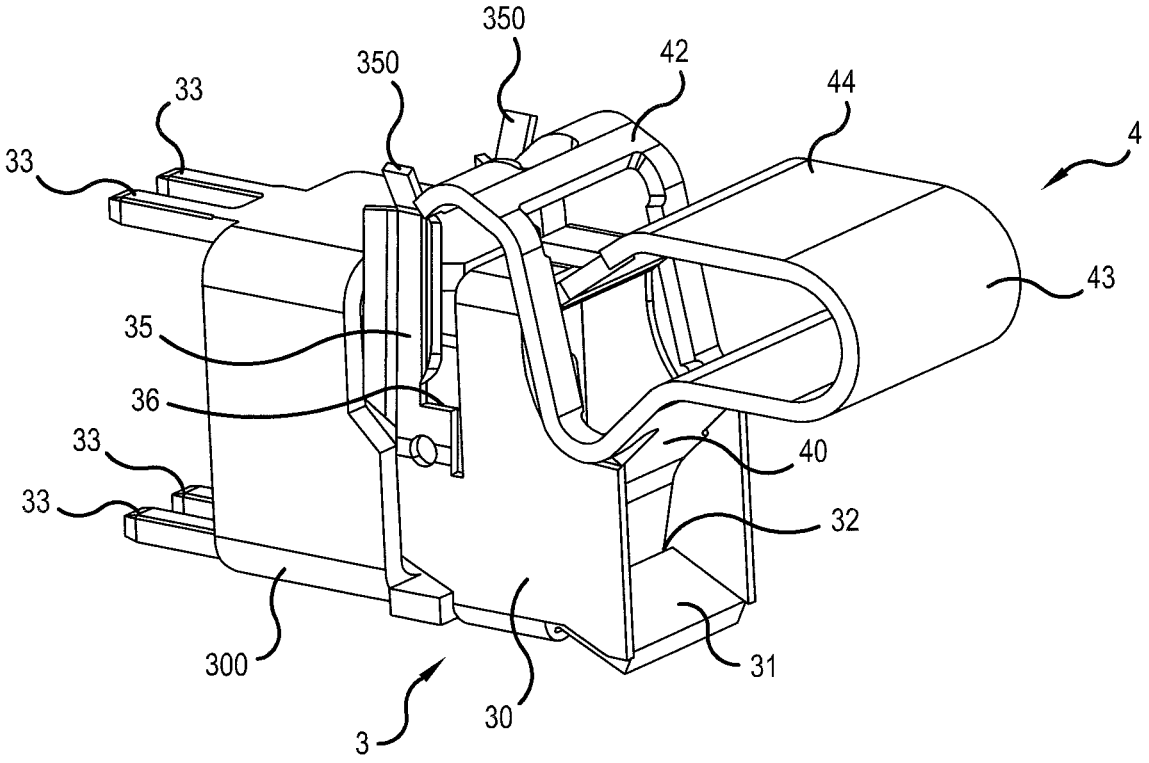
FIG. 10 shows a further contact insert of a conductor connection terminal in perspective view.

FIG. 10 shows the illustrated contact insert in the position shown in FIG. 1; i.e., the clamping point is closed. The contact insert has the elements already explained with reference to the previous embodiments.

Figure 12:
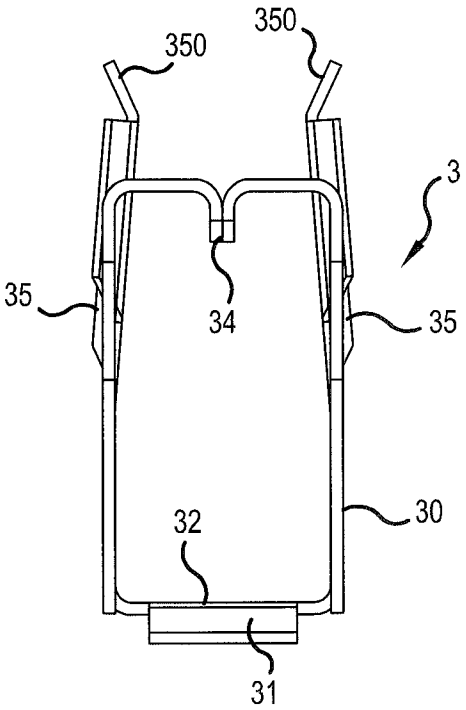
FIG. 12 shows the retaining cage according to FIG. 11 in a viewing direction corresponding to FIGS. 2, 4, and 6.
Figure 11:
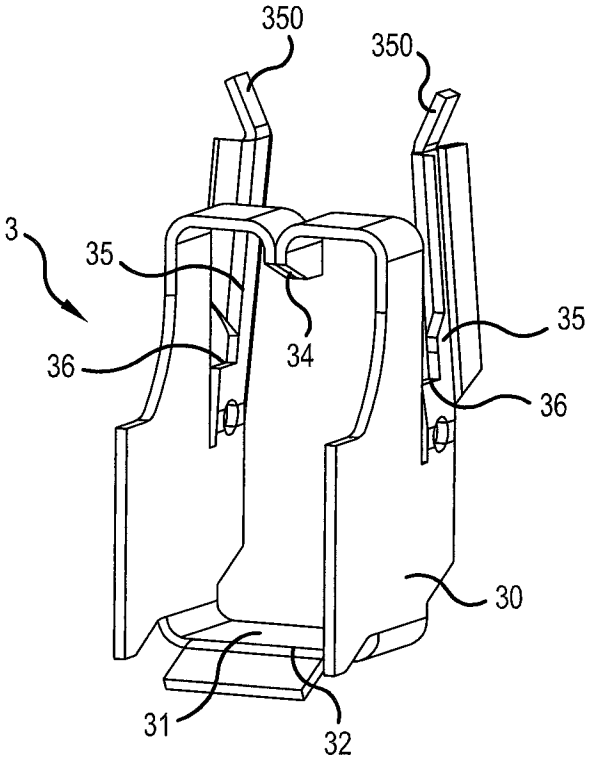
FIG. 11 shows a retaining cage of the contact insert according to FIG. 10 in a perspective view.

As is also made apparent in particular by the detailed drawing of individual parts in FIGS. 11 and 12, spring-holding elements 35, which are integrally disposed on retaining cage 30, at their upwardly projecting free ends each have tabs 350, which are set obliquely towards the outside. Tabs 350 form insertion bevels, which simplify the insertion of actuating lever 5 in the contact insert and the insertion of spring-releasing elements 54.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A conductor connection terminal comprising:

an insulating-material housing;

a spring-force clamping connection point, which is disposed in the insulating-material housing;

a clamping spring;

a pivotably mounted actuating lever for actuating the clamping spring, the actuating lever being movable from a closed position to an open position and vice versa, the actuating lever having a driver element for deflecting a clamping leg of the clamping spring in order to open a clamping point of the conductor connection terminal, which clamping point is formed with the clamping leg;

at least one spring-holding element that is not disposed on the actuating lever for holding the clamping leg in the open position such that the actuating lever is not loaded with a restoring force of the clamping spring when the clamping point is open; and at least one spring-releasing element disposed on the actuating lever, the at least one spring-releasing element being adapted to be coupled to the at least one spring-holding element during at least one segment of a restoring motion of the actuating lever from the open position to the closed position, the at least one spring-holding element being mechanically actuated by the at least one spring releasing element in order to release the clamping leg held on the at least one spring-holding element.

2. The conductor connection terminal according to claim 1, wherein, as a result of the restoring motion of the actuating lever from the open position to the closed position, the at least one spring-holding element is deflected transversely to the pivoting plane of the actuating lever by the at least one spring releasing element.

3. The conductor connection terminal according to claim 1, wherein the at least one spring-releasing element is configured for the mechanical actuation of the at least one spring-holding element for releasing the clamping leg in a region of at least the last 30% of the pivoting movement of the actuating lever from the open position to the closed position.

4. The conductor connection terminal according to claim 1, wherein the at least one spring-releasing element is disposed laterally on the actuating lever.

5. The conductor connection terminal according to claim 1, wherein the actuating lever has a radial outer bearing region for mounting the actuating lever, wherein the radial outer bearing region overlaps, at least in sections, with the at least one spring-holding element and is configured for the mechanical actuation of the at least one spring-holding element for releasing the clamping leg during the restoring motion of the actuating lever from the open position to the closed position.

6. The conductor connection terminal according to claim 5, wherein the radial outer bearing region of the actuating lever has a varying thickness along a radial circumference in the transverse direction to the pivoting plane of the actuating lever, which forms the at least one spring-releasing element.

7. The conductor connection terminal according to claim 1, wherein the at least one spring-holding element is formed as an elastically deflectable metal plate.

8. The conductor connection terminal according to claim 1, wherein the at least one spring-holding element is disposed on a retaining cage or retaining bracket which is used for fixing the clamping spring and/or a busbar of the conductor connection terminal.

9. The conductor connection terminal according to claim 1, wherein the conductor connection terminal has at least two of the at least one spring-holding element disposed on opposite sides of the actuating lever and being bent inward towards one another.

10. The conductor connection terminal according to claim 9, wherein, in the restoring motion of the actuating lever from the open position to the closed position, the at least two of the at least one spring-holding element are deflected away from one another by the at least one spring-releasing element.

11. The conductor connection terminal according to claim 1, wherein the at least one spring-releasing element includes a first spring-releasing element that protrudes from a first side of the actuating lever and a second spring-releasing element that protrudes from a second side of the actuating lever, such that the first spring-releasing element, the second spring-releasing element and the actuating lever form a T-shape.

12. The conductor connection terminal according to claim 1, wherein the at least one spring-holding element is bent inward when holding the clamping leg in the open position, and wherein the at least one spring-holding element is mechanically actuated by being deflected outward by the at least one spring-releasing element during the at least one segment of the restoring motion of the actuating lever from the open position to the closed position.

* * * * *